US006138799A

United States Patent [19]

Schröder-Brumloop et al.

[11] Patent Number: 6,138,799

[45] Date of Patent: Oct. 31, 2000

[54] BELT-CLIMBING ELEVATOR HAVING DRIVE IN COUNTERWEIGHT

[75] Inventors: Helmut Schröder-Brumloop, Berlin, Germany; Jean Marc Ferrary, Paris, France; Armando Servia, Madrid, Spain; Pascal Rebillard, Gien, France; Richard J. Ericson, Southington, Conn.

[73] Assignee: Otis Elevator Company, Farmington, Conn.

[21] Appl. No.: 09/163,584

[22] Filed: Sep. 30, 1998

[51] Int. Cl.[7] ..... B66B 11/04

[52] U.S. Cl. ..... 187/452; 187/450; 187/411; 187/404; 254/333

[58] Field of Search ..... 74/89.21; 187/250, 187/252, 360, 404, 251, 405, 411, 412; 254/372, 333

[56] References Cited

U.S. PATENT DOCUMENTS

| | | | |
|---|---|---|---|
| 1,071,309 | 8/1913 | Goggin . | |
| 1,730,974 | 10/1929 | Higbee | 187/404 |
| 2,405,691 | 8/1946 | Ellis . | |
| 3,101,130 | 8/1963 | Bianca . | |
| 3,878,916 | 4/1975 | White, Jr. | 182/145 |
| 4,570,753 | 2/1986 | Ohta et al. | 187/1 |
| 4,949,815 | 8/1990 | Pavoz | 187/20 |
| 5,062,501 | 11/1991 | Pavoz et al. | 187/112 |
| 5,429,211 | 7/1995 | Aulanko et al. | 187/254 |
| 5,435,417 | 7/1995 | Hakala | 187/404 |
| 5,469,937 | 11/1995 | Hakala et al. | 187/266 |
| 5,490,578 | 2/1996 | Aulanko et al. | 187/254 |
| 5,566,785 | 10/1996 | Hakala | 187/250 |
| 5,573,084 | 11/1996 | Hakala | 187/252 |

FOREIGN PATENT DOCUMENTS

| | | |
|---|---|---|
| 1 032 496 | 6/1958 | Australia . |
| 0 565 516 | 4/1993 | European Pat. Off. . |
| 0 606 875 A1 | 1/1994 | European Pat. Off. . |
| 0 779 233 A2 | 6/1994 | European Pat. Off. . |
| 0 784 030 A2 | 6/1994 | European Pat. Off. . |
| 0631969 | 6/1994 | European Pat. Off. . |
| 0 688 735 A2 | 6/1995 | European Pat. Off. . |
| 0 710 618 A2 | 10/1995 | European Pat. Off. . |
| 0 749 930 A2 | 6/1996 | European Pat. Off. . |
| 0 749 931 A2 | 6/1996 | European Pat. Off. . |
| 2 640 604 | 12/1988 | France . |
| 1506479 | 12/1969 | Germany . |
| 1 401 197 | 6/1972 | Germany . |
| 2333120 | 1/1975 | Germany . |
| 3834790 A1 | 10/1988 | Germany . |
| 296 15 921 U1 | 4/1997 | Germany . |
| 1-242386 | 9/1989 | Japan . |
| 2 138 397 | 11/1985 | United Kingdom . |
| 2 2-1 657 | 8/1990 | United Kingdom . |
| WO 96/09978 | 4/1996 | WIPO . |
| PCT/FI97/00823 | 12/1997 | WIPO . |
| PCT/FI97/00824 | 12/1997 | WIPO . |

OTHER PUBLICATIONS

PCT Search Report for Serial No. PCT/US99/03641 dated Jul. 1, 1999.

"Elevator Mechanical Design, Principles and Concepts", by Lubomir Janovsky, Ellis Horwood Limited (1987).

"Hannover Fair: Another new idea from ContiTech—Lifting belts for elevators", ContiTech initiativ Jan. 1998 (Hannover Fair '98).

*Primary Examiner*—Robert P. Olszewski
*Assistant Examiner*—Thuy V. Tran

[57] ABSTRACT

An elevator system includes a counterweight-drive assembly (26) having a motor (32) and drive pulley (36) mounted internally to engage a drive belt (42) for climbing or descending with respect thereto, resulting in raising or lowering of an elevator car (12) coupled to said counterweight-drive assembly (26).

5 Claims, 3 Drawing Sheets

BELT-CLIMBING ELEVATOR HAVING DRIVE IN COUNTERWEIGHT

TECHNICAL FIELD

The present invention relates to elevator systems and, more particularly, to an elevator guide system requiring less installation and operation space than conventional elevator systems by utilizing combined function structures so that an elevator counterweight houses a drive system.

BACKGROUND OF THE INVENTION

Known elevator systems typically confine all elevator components to the hoistway or the machine room. The hoistway is an elongated, vertical shaft having a rectangular base in which the elevator car translates. The hoistway houses, among other things, the car guide rails which are usually a pair of generally parallel rails, fixed to opposite walls near the center of each wall, and running the approximate length of the hoistway. A counterweight having a pair of guide rails is positioned adjacent to a third wall. The hoistway houses additional components including terminal landing switches, ropes and sheave arrangements, and buffers for the counterweight and the car.

It is essential that the elevator components are located and oriented with precision prior to and during operation. The interior walls of the hoistway must be properly dimensioned and aligned, and the physical interface between the hoistway walls and the elevator components must be capable of withstanding varying load during use. It is particularly essential that the guide rails on which the car rides are properly positioned and solidly maintained. For quality of ride and safety, the guide rails need to be precisely plumb, square and spaced to avoid car sway, vibration and knocking. Guide rails are typically steel, T-shaped sections in sixteen foot lengths. The position of guide rails within the hoistway affects the position of the hoisting machine, governor and overhead (machine room) equipment. The machine room is typically located directly above the hoistway. The machine room houses the hoist machine and governor, the car controller, a positioning device, a motor generator set, and a service disconnect switch.

Because the various components of the hoistway and machine room require precise positioning and they produce varying and substantial loads, it is costly and complicated to assemble a typical traction elevator system.

OBJECTS AND SUMMARY OF THE INVENTION

It is an object of the present invention to provide an improved elevator system that optimizes use of space by providing a multi-function component that functions as a counterweight and a support for the drive machine and system, so that the need for a machine room and other space-consuming components is eliminated. It is a further object to provide an improved elevator system that achieves optimum efficiency in construction and materials by various means including, for example, providing a counterweight apparatus that stores potential energy as an integral part of the lift arrangement and that reduces the required torque for movement of the elevator car.

The present invention achieves the aforementioned and other objects by utilizing a novel arrangement of a drive machine and components housed within and moveable with a counterweight. In one embodiment, a counterweight-drive assembly includes a motor and drive pulley sized to maintain a narrow profile and to be suspended and to move in coordination with an elevator car. The counterweight-drive assembly is connected to an elevator car by one or more suspension ropes or belts. A traction belt, preferably toothed, is adapted to engage the drive pulley and is fixed vertically in the hoistway to form the counterweight-drive assembly path. The traction belt need not necessarily be a toothed belt. A conventional rope or a flat rope or belt may be used. As used herein, the terms "flat belt" and "flat rope" mean a belt or rope having an aspect ratio of greater than one, where the aspect ratio is the ratio of the belt or rope width to the thickness. When torque is applied through the drive pulley, the counterweight-drive assembly is caused to move up or down the hoistway. Additional deflection rollers guide the traction belt around the drive pulley to attain sufficient surface contact area and resultant traction. Because a flat belt is used, sufficient traction is achieved with a small diameter drive pulley, thus conserving space. The optional use of a flat, toothed belt enhances traction further.

In another embodiment of the present invention, a counterweight-drive assembly includes a modular motor arrangement of four drive motors mounted to a counterweight body. Each motor has a sheave that cooperates with one of two fixed ropes attached at a hoistway ceiling and tensioned at the other end by a spring or tensioning weight. The motors and sheaves are preferably positioned at the four corners of the counterweight body. The motors and sheaves are proportioned and arranged to minimize thickness of the assembly and, thus, spaced required for mounting and operation. The path of the ropes around the upper and lower sheaves provides 360 degree effective wrap around for high traction. The use of multiple drive sheaves enables a large collective traction area with small diameter sheaves and small motors, thereby conserving space. Another advantage of using multiple drive sheaves and corresponding motors is that, in the event of failure of one motor, the others can continue the operation of the elevator system provided that they are sufficiently powered.

By having suspension belts separate from a traction belt, each can be respectively optimized for its particular function without concern for other performance characteristics, For example, the suspension ropes can be optimized for tension failure since they are not required to provide a traction medium. Further, the traction rope can be optimized for traction with only limited concern for tension failure, as the maximum tension it is subjected to results from the mass difference between the car and the counterweight. Additionally, the use of traction belts enables a reduction in motor size where, for example, cylindrical motors can be implemented instead of flat motors.

DESCRIPTION OF THE PREFERRED EMBODIMENTS

Figure 1:
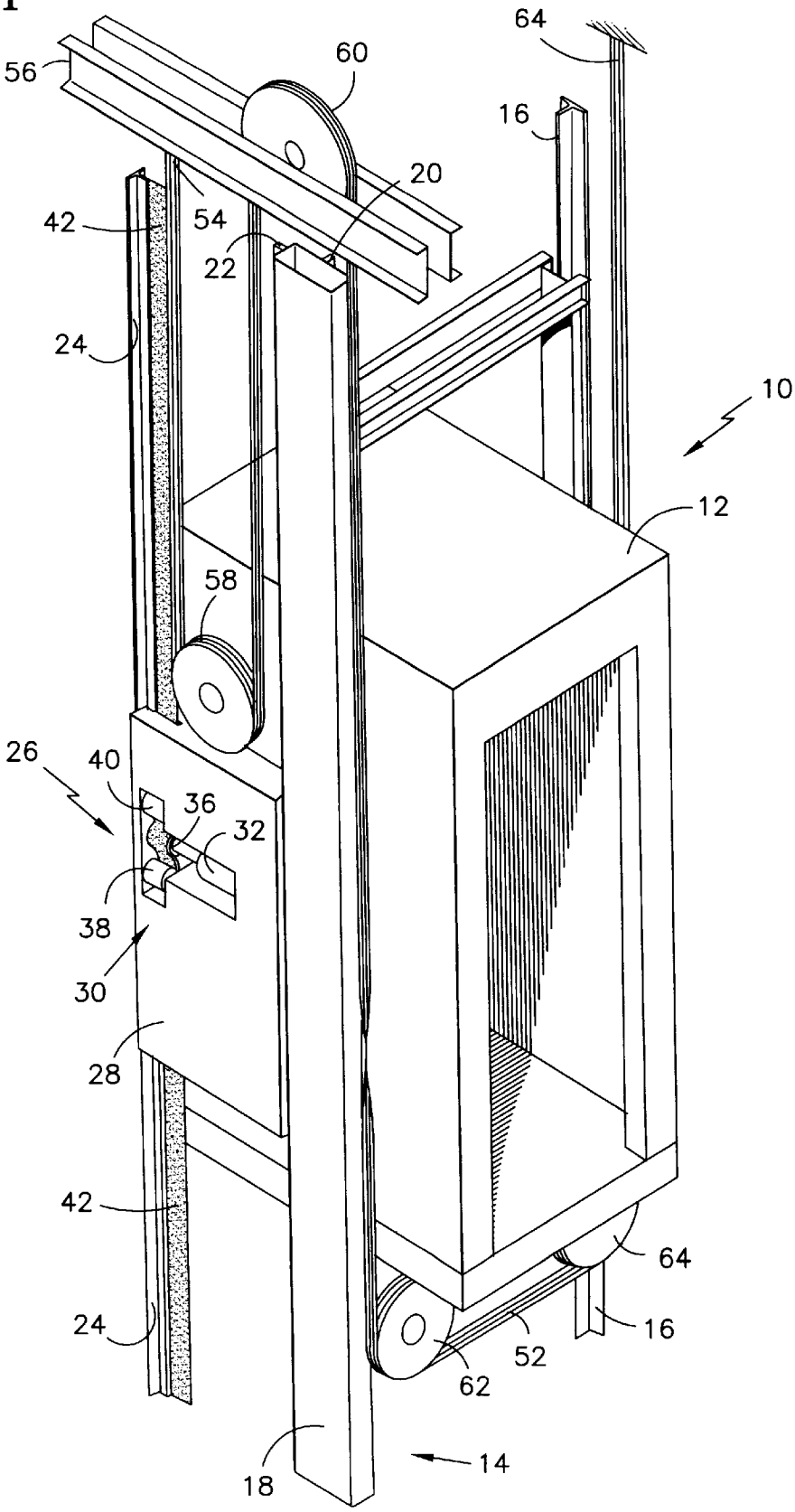
FIG. 1 is an orthogonal, schematic view of a first embodiment of the present invention elevator assembly.
Figure 2:
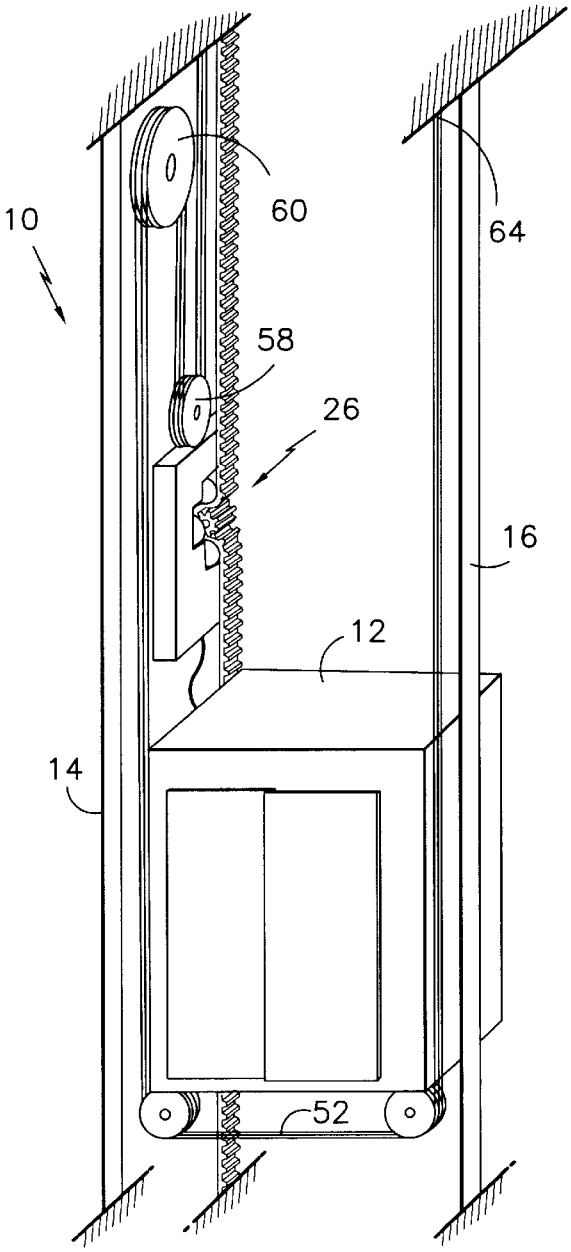
FIG. 2 is a perspective, schematic view of the elevator assembly as shown in FIG. 1.

An elevator assembly according to a first embodiment of the present invention is illustrated in FIGS. 1–4. An elevator assembly (10) includes an elevator car (12) and a guide rail assembly (14). The guide rail assembly (14) comprises an elongated, vertical member (18) having at least two faces for fixing, respectively, a first elevator car guide rail (20) and a first counterweight guide rail (22). The vertical member (18) may be attached to a stationary structure such as a wall of the hoistway (not shown). A second elevator car guide rail (16) is positioned opposite of and facing the first elevator car guide rail (20). The two elevator car guide rails (20, 16) are adapted to slidingly receive the elevator car (12) in a conventional manner through the use of conventional guide shoes (not shown) or the like. A second counterweight guide rail (24) is positioned opposite of and facing the first counterweight guide rail (22) in such a way that the two counterweight guide rails (22, 24) lay in a plane that is generally orthogonal to the plane in which the elevator car guide rails (16, 20) lay.

Figure 3:
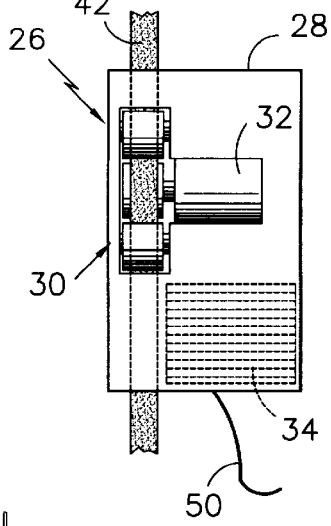
FIG. 3 is a schematic, side view of a component of the elevator assembly of FIG. 1.
Figure 4:
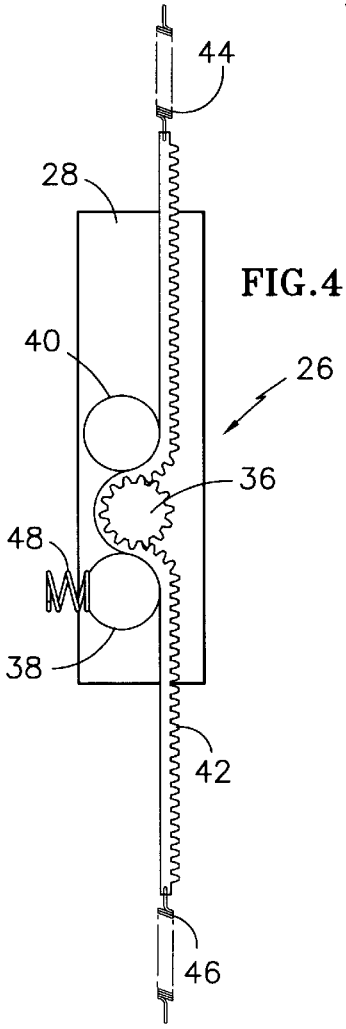
FIG. 4 is a schematic, front view of component of FIG. 3.

The counterweight-drive assembly (26) comprises a body (28) housing a drive assembly (30), a motor (32), and weights (34), as shown in FIG. 4. Components of the drive assembly (30) are shown schematically in FIG. 3 and include a toothed drive pulley (36) adapted to provide torque from the motor (32), and first and second deflection pulleys (38, 40) for effecting surface contact of the toothed belt (42) along a predetermined surface area of the drive pulley (36) for predetermined traction. Also shown schematically in FIG. 3 are tension varying devices (44, 46) which may be of a conventional type such as springs (not shown). A belt-tensioning device (48) is shown schematically and it may also be of a conventional type such as a spring (not shown). The motor (32) can be an electric motor and can be supplied power and control signals via a power and control cable (50) as shown, whereby the cable (50) is adapted to move with the counterweight-drive assembly (26).

A rope, group of ropes or suspension belt (52), as shown, suspends both the elevator car (12) and the counterweight-drive assembly (26). A first end (54) of the suspension belt (52) is fixed to a stationary object overhead, such as a beam (56) of the ceiling of the hoistway (not shown). A first idler pulley (58) fixed to the counterweight-drive assembly (26) engages the suspension belt (52). A second idler pulley (60) fixed to the overhead beam (56) engages the suspension belt (52). Third and fourth idler pulleys (62, 64) are fixed to the bottom of the elevator car (12) and also engage the belt (52). The third and fourth idler pulleys (62, 64) need not necessarily be positioned under the elevator car (12) and may be, for example, replaced by one or more idler pulleys positioned above the car. The second end (64) of the suspension belt (52) is fixed relative to the hoistway (not shown) at a height sufficient to enable desired vertical movement of the elevator car (12) and counterweight-drive assembly (26) as will be described below.

In operation, when the motor (26) is energized, torque is transferred through the toothed drive pulley (32) to the toothed belt (42) such that the counterweight-drive assembly (26) will move along and relative to the toothed belt (42). The counterweight-drive assembly (26) will selectively move up or down depending on the direction of rotation of the toothed drive pulley (36). When the counterweight-drive assembly (26) is caused to move downward along the toothed belt (42) the first idler pulley (58) moves downward with it thereby lengthening the amount of belt (52) between the first and second idler pulleys (60). As a result, the length of available belt (52) extending past the second idler pulley (60) is proportionally shortened and the elevator car (12) is caused to be lifted upward on the third and fourth idler pulleys (62, 64). In a similar manner, the elevator car (12) is lowered as the counterweight-drive assembly (26) is driven upward.

As can be seen from the foregoing description of the first embodiment, the present invention eliminates the need for a machine room, requires less total material, and enables use of small diameter drive (36) and idler pulleys (58, 60, 62, 64) because traction is dependent only on a toothed pulley arrangement. The machine or drive assembly (26) can be accessed either from the bottom of the hoistway or through a window or opening in the elevator car (12) when positioned in alignment. The design of the present invention eliminates body-conducted vibrations and noise from the motor (32) to the car (12) or building. The toothed belt (42) and suspension belt (52) inherently dampen vibrations. The counterweight-drive assembly (26) may be pre-assembled and pre-tested to save on installation time and to increase reliability. The use of a toothed belt (42) and drive pulley (36) eliminates slippage and provides for absolute positioning. Since traction is not dependent upon weight, a light-weight car (12) can be used, enabling the use of a smaller and more efficient motor (32).

Figure 5:
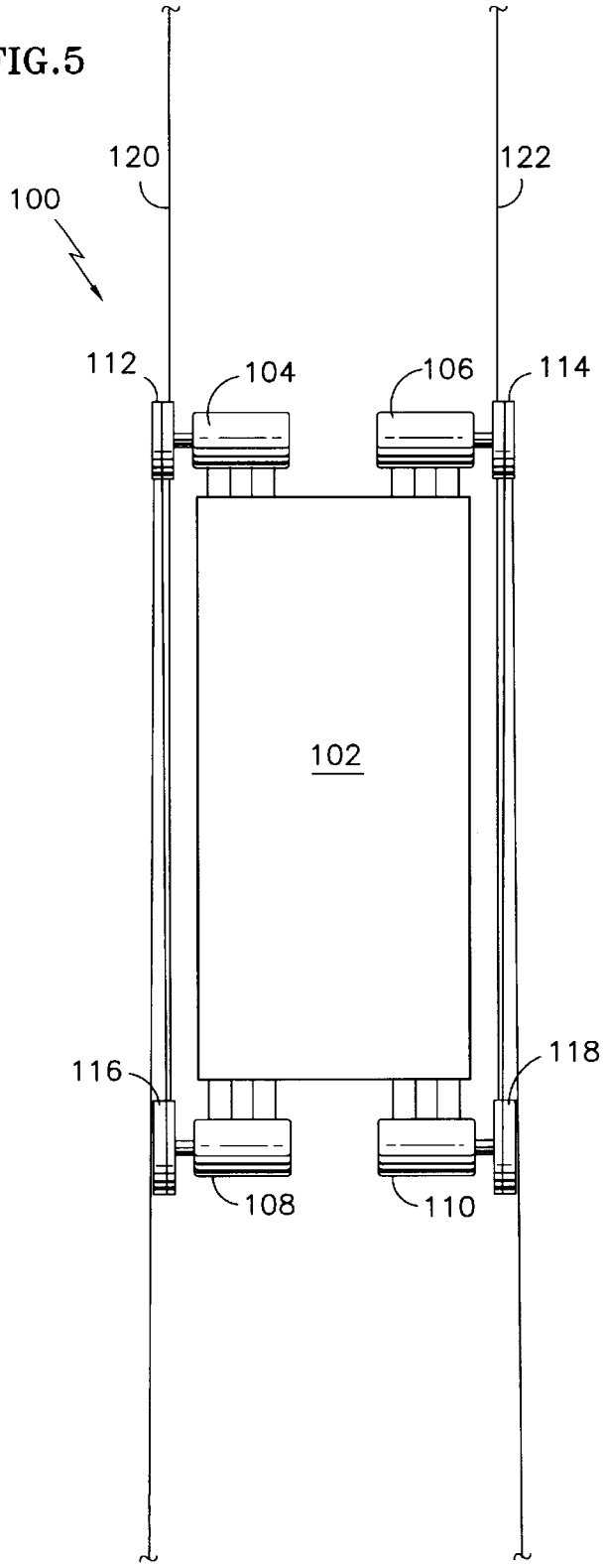
FIG. 5 is a schematic, front view of a second embodiment of the present invention elevator assembly.
Figure 6:
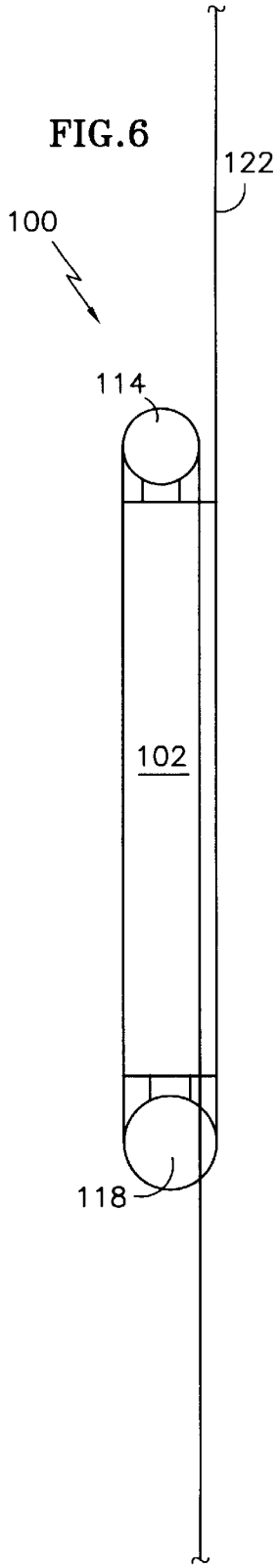
FIG. 6 is a schematic, side view of the elevator assembly of FIG. 5.

Referring now to FIGS. 5–6, a second embodiment of the present invention is directed to a self-climbing counterweight-drive assembly (100). The counterweight-drive assembly (100) can be adapted to be used with a belt (52) and idler (58, 60, 62, 64) arrangement in accordance with FIGS. 1–4 or in a similar fashion to couple the assembly (100) with an elevator car (12). As is the case of the first embodiment, movement of the elevator car (12) will be dependent upon movement of the counterweight-drive assembly (100).

The counter-weight drive assembly (100) of the second embodiment includes a body (102) having fixed thereon a group of four electric motors (104, 106, 108, 110). Each motor (104–110) is equipped with a corresponding drive sheave (112, 114, 116, 118). A pair of fixed ropes (120, 122) are attached to an overhead structure (not shown) in the hoistway (not shown) and are either fixed or tensioned by conventional means (not shown) at the bottom. As shown specifically in FIG. 6 with respect to the second rope (122), each rope (120, 122) extends downwardly to engage and wrap under a lower drive sheave (118), extends upwardly to engage and wrap over an upper drive sheave (114), and extends downward again to be tensioned or fixed.

The traction between the ropes (120, 122) and sheaves (112–118) is controlled by adjusting the tension in each respective rope (120, 122). It is preferred that the ropes (120, 122) are flat ropes because they are capable of wrapping around small diameter sheaves while supplying sufficient traction. It is then possible to minimize profile thickness of the assembly (100).

As is the case in the first embodiment, traction is not dependent upon weight and, therefore, a light weight elevator car (12) can be implemented. In the second embodiment, each drive sheave (112–118) is engaged by one of the ropes (120, 122) about 180 degrees and, thus, the total effective wrap angle is about 360 degrees on each side. The total wrap angle is determinative of the total traction.

It is conceivable to vary the second embodiment by powering only two of the four motors, or by providing one motor with transmission components to drive all four sheaves. It is further conceivable to provide only one rope instead of two.

As can be realized from the foregoing description of the second embodiment, mounting motors on a counterweight-drive assembly (100) will remove vibration and noise from the car (12). The positioning of the drive sheaves (112–118) makes sheave mounting and servicing convenient. The ability to use small motors (104–110) provides costs savings.

While the preferred embodiments have been herein described, it is acknowledged that variations to these embodiments can be made without departing from the scope of what is claimed.

We claim:

1. An elevator system comprising a suspension member;

a drive belt fixed within an elevator hoistway;

a counterweight-drive assembly engaged with the suspension member and having drive means for engaging only said drive belt in traction and driving said counterweight-drive assembly relative thereto; and an elevator car engaged with the suspension member for concurrent movement of the car and counterweight;

whereby said car is moved in response to movement of said counterweight-drive relative to the drive belt.

2. An elevator system according to claim 1, wherein said suspension member comprises a series of idler pulleys, including a first idler pulley fixed to said counterweight-drive means, a second idler pulley fixed relative to the hoistway, and at least one idler pulley fixed to said elevator car.

3. An elevator system according to claim 1, wherein said drive belt is a toothed belt.

4. An elevator system according to claim 3, wherein said drive means include an electric motor and a toothed drive pulley.

5. An elevator system according to claim 1, wherein said drive belt is a flat rope.

* * * * *